US005697247A

United States Patent [19]

Zehr

[11] Patent Number: 5,697,247

[45] Date of Patent: Dec. 16, 1997

[54] APPARATUS FOR MEASURING THE THICKNESS AND/OR IRREGULARITY OF SLIVERS

[75] Inventor: Jürg Zehr, Uster, Switzerland

[73] Assignee: Zellweger Luwa AG, Uster, Switzerland

[21] Appl. No.: 673,503

[22] Filed: Jul. 1, 1996

[30] Foreign Application Priority Data

Jun. 29, 1995 [CH] Switzerland ..... 01 908/95

[51] Int. Cl.[6] ..... D01H 5/00

[52] U.S. Cl. ..... 73/160; 73/37.7

[58] Field of Search ..... 73/37.5, 37.7, 73/159, 160; 19/239, 240

[56] References Cited

U.S. PATENT DOCUMENTS

| | | | |
|---|---|---|---|
| 3,593,566 | 7/1971 | Loopuyt | 73/37.7 |
| 3,822,590 | 7/1974 | Tharpe et al. | 73/160 |
| 3,854,330 | 12/1974 | Wildbolz | 73/160 |
| 3,925,850 | 12/1975 | Lytton | 73/160 |
| 3,990,292 | 11/1976 | Stern | 73/37.7 |
| 4,122,703 | 10/1978 | Davis | 73/37.7 |
| 4,184,361 | 1/1980 | Erben | 73/37.7 |
| 4,318,299 | 3/1982 | Morf | 73/160 |
| 4,481,820 | 11/1984 | Thomann | 73/160 |
| 4,706,014 | 11/1987 | Fabbri | 73/160 |
| 4,766,647 | 8/1988 | Ackermann, Jr. | 73/160 |
| 4,864,853 | 9/1989 | Grunder et al. . | |
| 5,461,757 | 10/1995 | Leifeld | 19/239 |

FOREIGN PATENT DOCUMENTS

| | | |
|---|---|---|
| 0 069 833 | 1/1983 | European Pat. Off. . |
| 1 50 487 | 5/1971 | Germany . |

*Primary Examiner*—Ronald L. Biegel

*Attorney, Agent, or Firm*—Burns, Doane, Swecker & Mathis, LLP

[57] ABSTRACT

The invention relates to a device for measuring the thickness and/or irregularity of slivers, with a compacting part (2) compacting the sliver and with a measuring part which has a gutter-like guide conduit (8) for the compacted sliver and a sensing member (10) which senses the sliver mechanically and which is adjustable relative to the guide conduit. In order to allow more accurate measurement, the sensing member is likewise of gutter-like design in a region in contact with the sliver and forms a kind of guide conduit (15), so that, in the measuring part, the sliver runs through a guide conduit consisting of a fixed part (13) and of a part (14) adjustable relative to the fixed part (13). The adjustable part is fastened to deflectable carriers (11, 12), and the measurement of the thickness and/or irregularity of the sliver is carried out by measuring the adjustment of at least one of the said carriers.

1 Claim, 2 Drawing Sheets

Fig. 3
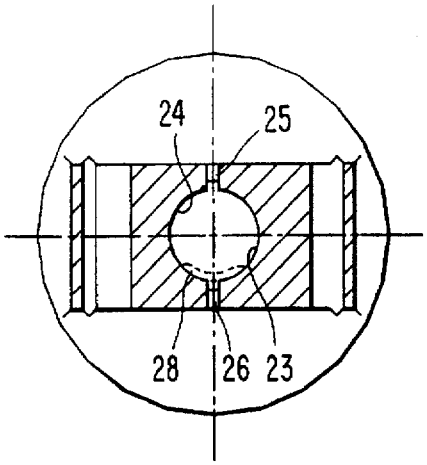
Fig. 4
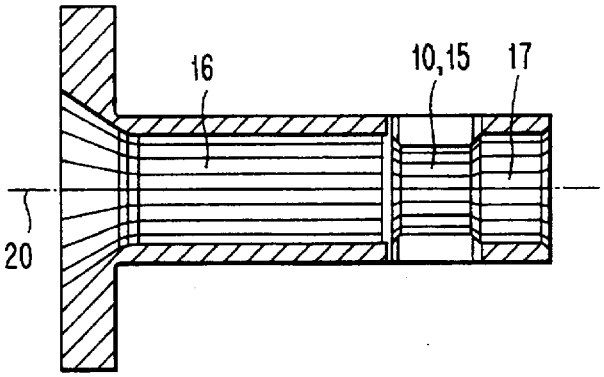
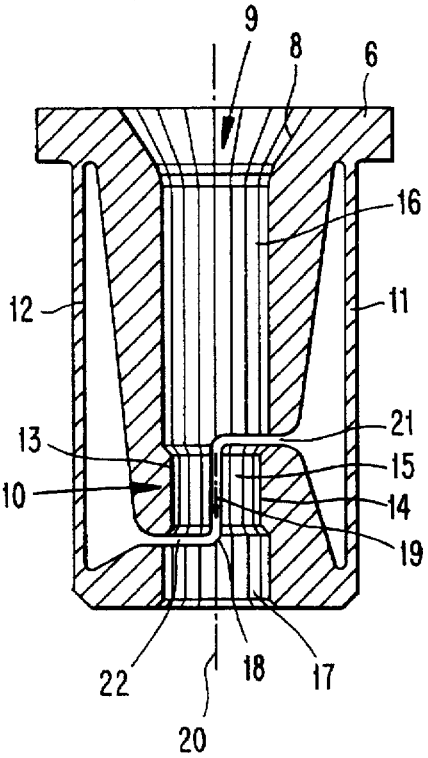
Fig. 2
Fig. 5
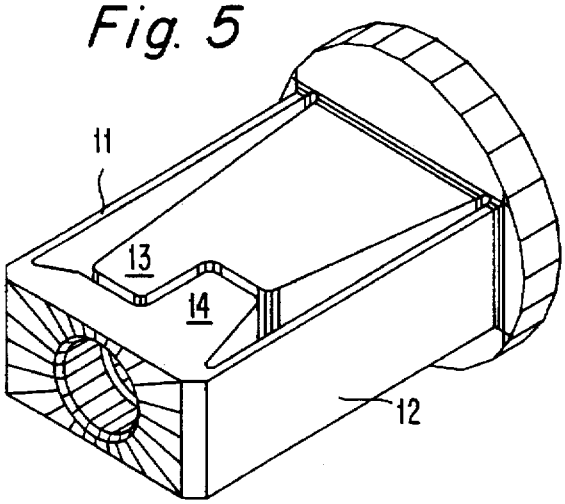
Fig. 6
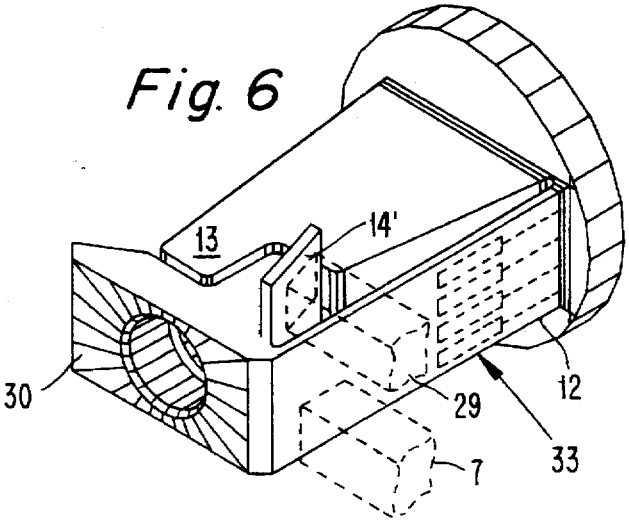

APPARATUS FOR MEASURING THE THICKNESS AND/OR IRREGULARITY OF SLIVERS

FIELD OF THE INVENTION

This invention relates to apparatus for measuring the thickness and/or irregularity of textile slivers. It is concerned particularly with sliver measurement apparatus having a measuring part provided with a gutter-like guide conduit for the sliver and a sensing member which senses the sliver mechanically and which is adjustable or deflectable relative to the guide conduit.

BACKGROUND OF THE INVENTION

Measuring apparatus of this general type is known, for example, from U.S. Pat. No. 4,864,853. This device contains a funnelshaped compacting member and a measuring member on the latter for measuring the thickness of a sliver running through a measuring conduit. In this case, the sliver is sensed by a leaf spring provided with strain gauges and which forms a sensing and measuring member. In the region of the leaf spring, the measuring conduit has a gutter-shaped design with a semicircular cross-section.

In this known device, there is the possibility that the leaf spring will heat up as a result of friction with the sliver. However, the strain gauges are highly sensitive to temperature. This means that they may supply different measured values depending on the temperature, and additional measures for compensating these influences have to be provided. A further disadvantage arises because the measuring conduit is closed off on one side by the leaf spring and in this region has corners which are usually not filled by the sliver. This results in a non-uniform filling of the measuring conduit by the sliver, which impairs the measuring accuracy. Since the leaf spring is connected to a measuring system so as to be releasable only with difficulty, adaptation to different measuring ranges, for example by exchanging the leaf spring or the measuring system, is somewhat complicated.

SUMMARY OF THE INVENTION

A feature of the present invention is that it provides a device which avoids the disadvantages mentioned and which allows more accurate measurement of the thickness and/or irregularity of a sliver.

This is achieved in that the measuring conduit has a deflectable or adjustable part which is in contact with the sliver so that it may move slightly relative to the sliver axis. The moveable part has a gutter-like design including a curved surface which together with a corresponding surface of an adjacent fixed part provides a passage of substantially closed cross section for the sliver. This moveable part is mounted on resilient carriers. At the same time, the deflection of the adjustable part caused by the sliver is recorded, preferably contactlessly. The measuring means is therefore separated from the part which is moved by the sliver. This can also be guaranteed by recording the deflection not on the adjustable part itself, but on the resilient carriers.

The advantages afforded by the device according to the invention are to be seen, in particular, in that, on the one hand, the actual measuring element can be separated thermally and mechanically from those elements which are in contact with the sliver. Moreover, the construction provides a sliver measuring conduit which preferably has a circular or oval cross-section, and in any case forms a limiting face which runs continuously, that is to say has no sharply changing radii or corners. This cross-section can be filled completely by the sliver without difficulty. Because the measuring element and that element which is in contact with the sliver are not coupled, they are both also easily exchangeable and the entire device can consequently easily be adapted to the properties of the sliver. Furthermore, measuring elements having a wider measuring range can be used.

BRIEF DESCRIPTION OF THE DRAWINGS

The invention is explained in more detail below by means of an example and with reference to the accompanying figures, of which FIG. 2 shows a section through part of the device, FIG. 3 shows a cross-section through the part of the device according to FIG. 2, FIG. 4 shows a longitudinal section through the part of the device according to FIG. 2, and FIG. 5 shows a perspective view of the part according to FIG. 2, and FIG. 6 is a view similar to FIG. 5, but showing a modified construction.

DETAILED DESCRIPTION OF PREFERRED EMBODIMENTS

Figure 1:
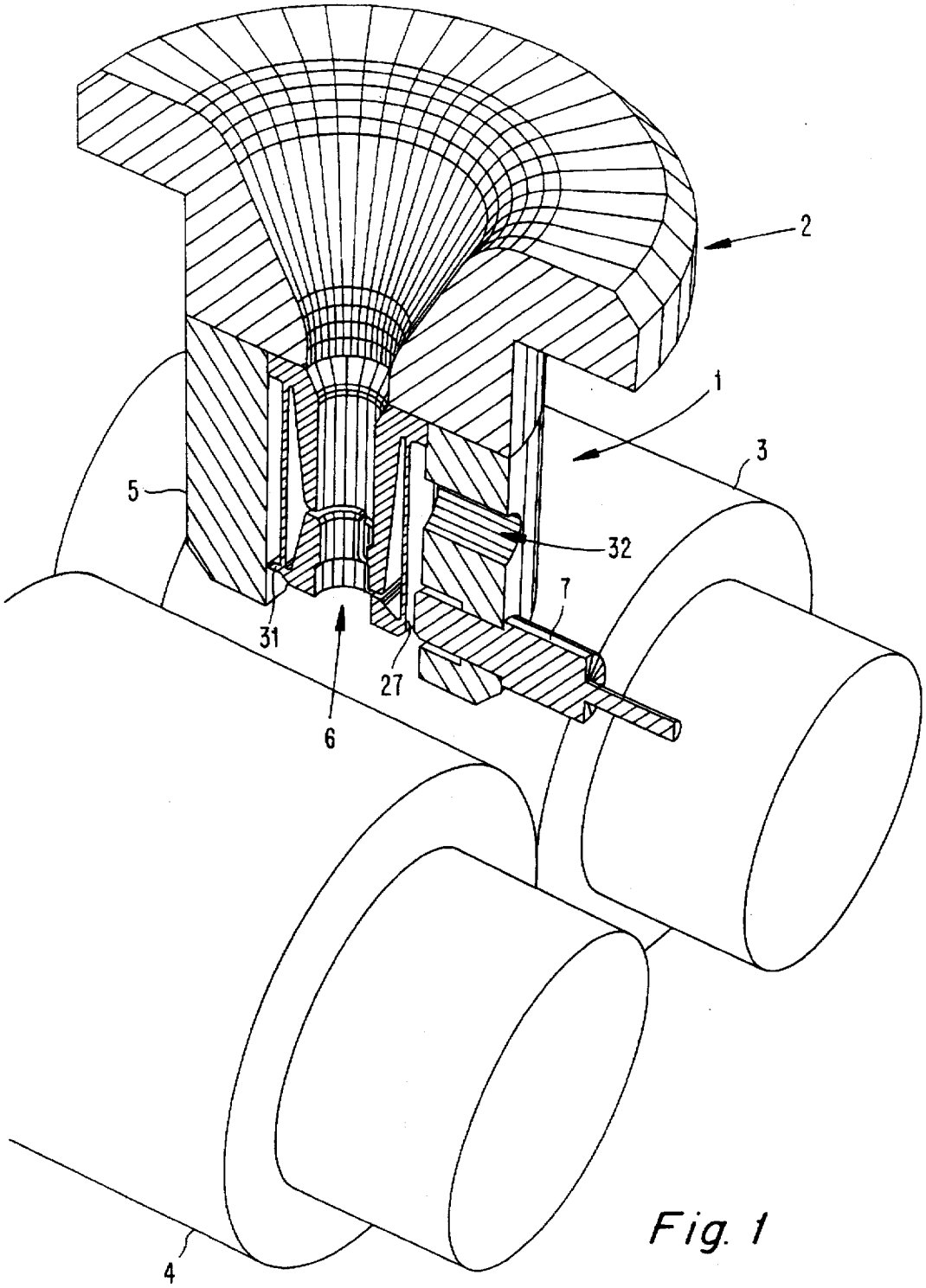
FIG. 1 shows a section through a perspective representation of an embodiment according to the invention.

FIG. 1 shows a device 1 according to the invention in its environment. It includes a so-called entry funnel 2 on one side of the device 1 and driven draw-off rollers 3, 4 for the sliver on the other side. The device 1 is arranged in a housing 5, in which a measuring part 6 and a measuring member 7 are mounted. The measuring member 7 is part of a non-contacting displacement measuring system which can measure a distance contactlessly. Such equipment can be purchased from MICRO-EPSILON MESSTECHNIK GmbH & Co. KG, Konigbacherstrasse 15, D-8359 Ortenburg-Dorfbach, Germany. In such systems, a coil potted in a housing is energized by a high frequency current to produce a magnetic field. Such field would extend to a conductive portion of the part 6 to induce eddy currents there which, in turn, would cause impedance variations in the coil proportional to displacements of the target portion of the part 6. The impedance variations are used to generate voltage variations directly proportional to the distance.

Alternatively, the measuring member 7 can also be designed as a pressure gauge or dynamometer which touches the measuring part 6, for the measuring principle used in this case is not always critical, as long as it allows the desired measuring accuracy. It is therefore also possible to have mechanical distance meters, in which there is a preferably releasable mechanical connection between the measuring part 6 and the measuring member 7.

FIG. 2 shows in particular the measuring part 6, which has a compacting part 8, a guide conduit 9, a sensing member 10 and deflectable carriers 11 and 12. The sensing member 10 is that part of the measuring part 6 which is in contact with the sliver, not shown here, for measurement, and it consists of a fixed part 13 and of a movable or adjustable part 14. The sensing member 10 is likewise of gutter-like design in a region in contact with the sliver and forms a kind of guide conduit 15. This is defined relative to the sliver by the fixed part 13 on the one hand, and by the adjustable part 14, on the other hand. As seen in the direction of movement of the sliver, the guide conduit 15 or the adjustable part 14 is preceded by a closed approach conduit 16, the cross-sectional area of which is larger than the cross-sectional area of the guide conduit 15, this being indicated here by a corresponding choice of diameters. This applies even when the adjustable part 14 is in a position of maximum deflection with respect to the fixed part 13. The guide conduit 15 is preferably formed by two half-shells, each of semicircular cross-section, one half-shell belonging to the fixed part 13 and one halfshell to the movable part 14. An exit conduit 17 follows the guide conduit 15 and, like the approach conduit 16, has a larger cross-section than the guide conduit 15. The fixed and adjustable parts 13, 14 of the measuring member 10 are separated from one another by a separating slit 18 which, in the region of the fixed and of the adjustable parts, has a portion 19, in which it runs parallel to an axis 20 of the measuring part. The separating slit 18 has portions 21 and 22 running radially in the region of the ends of the adjustable part.

FIG. 3 shows a section through the measuring part 6 in the region of the guide conduit 15. In this can be seen the already above mentioned half-shells 23 and 24 as well as parts 25 and 26 of the separating slit 18. A thin cover 28 can optionally be fastened to one of the half-shells 23 or 24, covering the separating slit 18 and preventing the sliver from being jammed in it. Nevertheless, other solutions for preventing this problem are also known.

The approach conduit 16, the guide conduit 15 or the sensing member 10 and the exit conduit 17 can be seen once again in FIG. 4, specifically from an angle of view rotated through 90° relative to FIG. 2.

FIG. 5 shows once more, in a view from outside, the fixed part 13 and the movable part 14 as well as the carriers 11 and 12 which are designed resiliently in the manner of a leaf spring.

FIG. 6 shows, in a further version, the fixed part 13 and the movable part 14' which, here, is fastened only to a single carrier 12. The movable part 14' can thereby be tilted away even more easily relative to the fixed part 13. This additional movement can be recorded by a further measuring system 29 in addition to the measuring system 7 referred to in connection with FIG. 1 or can be prevented by a guide acting in a region 30. Instead of the measuring systems 7 and 29, known strain gauges 33 can also be attached directly to the carrier 12. These are preferably connected to releasable connections in the entry funnel 2, so that the measuring part shown is exchangeable in this case too.

The mode of operation of the device according to the invention will now be described. The sliver enters via the entry funnel 2 and, drawn by the draw-off rollers 3 and 4 in a way known per se, runs through the measuring part 6. At the same time, it is compacted in the entry funnel 2 and in the compacting part 8 and passes thus into the approach conduit 16. Depending on the density of the sliver, the two halfshells 23, 24 or parts 13, 14 are urged more or less apart from one another in the sensing member 10 counter to the force of the resilient carrier or carriers 11, 12. The sliver subsequently runs through the exit part 17. As a result of the urging of the parts 13 and 14 apart from one another, the movable part 14 is newly positioned at least temporarily for the duration or length of a thick or thin place in the sliver, this being recorded by the measuring member 7. The latter continuously emits signals which correspond to the current position of the movable part 14. At the same time, as shown in Figure 1, the position of the part 14 can also be recorded via a portion 27 of a carrier. In order to improve measuring accuracy, the position of the adjustable part 14 can also be recorded at other or a plurality of points by a plurality of measuring members 7, 29. This is, for example, in order to monitor the parallelism of the two half-shells 23, 24 and increase measuring accuracy.

As is evident from FIG. 1, the movable part can also have a stop 31 which limits the movement of the movable part relative to the housing 5 and which thus prevents the carriers or measuring elements connected to them from being overstretched. Since the slivers to be measured may also cause a large amount of dust, it is possible to blow air into the housing 5 via an orifice 32 and thus build up excess pressure which keeps away the dust which could infiltrate from below.

The measuring part 6 can be exchanged easily in order to adapt the device to slivers having another density, other material or another speed. For this purpose, the measuring parts 6 can differ from one another in the shape of the half-shells 23, 24, the return force of the carriers 11, 12 or the mass of the adjustable part 14. In general, however, this measuring part 6 has a low mass and therefore a high natural resonant frequency. Shorter defects in the sliver can thus also be recorded.

What is claimed is:

1. Apparatus for measuring the thickness and/or irregularity of slivers comprising means providing a gutter-like guide conduit for the sliver; a sensing unit of gutter-like design for sensing the sliver mechanically, said sensing unit including a fixed first part and a second adjustable part fastened to at least one deflectable carrier and being moveable by the sliver relative to said first part to sense the thickness of the sliver; and a distance-measuring system isolated mechanically from the carrier for measuring movement of said adjustable part of said sensing unit.

* * * * *